United States Patent [19]

Ravins et al.

[11] Patent Number: 4,818,287

[45] Date of Patent: Apr. 4, 1989

[54] FIBER REINFORCED PLASTER MOLDS FOR METAL CASTING

[75] Inventors: Thomas L. Ravins, Portland; Dale R. Greve, Beaverton, both of Oreg.

[73] Assignee: Georgia-Pacific Corporation, Atlanta, Ga.

[21] Appl. No.: 648,354

[22] Filed: Sep. 7, 1984

Related U.S. Application Data

[63] Continuation of Ser. No. 379,933, May 19, 1982, abandoned.

[51] Int. Cl.[4] ..... B22C 1/00

[52] U.S. Cl. ..... 106/38.3; 106/38.9; 106/109; 164/523; 164/529

[58] Field of Search ..... 164/520, 523, 529; 106/38.3, 38.9, 109

[56] References Cited

U.S. PATENT DOCUMENTS

| | | | |
|---|---|---|---|
| 512,845 | 1/1894 | Smith | 164/529 |
| 598,632 | 2/1898 | Johnston | 106/38.9 |
| 1,901,051 | 3/1933 | Randel et al. | 106/109 |
| 1,941,188 | 12/1933 | Randel | 106/109 |
| 2,616,789 | 3/1951 | Hoggatt | 106/109 |
| 3,337,298 | 8/1967 | Ruter et al. | 106/109 |
| 3,822,340 | 3/1972 | Eberal et al. | 106/109 |
| 4,029,512 | 6/1977 | Jaunarajs et al. | 106/109 |
| 4,081,283 | 3/1978 | Lankard | 106/38.9 |
| 4,152,408 | 5/1979 | Winslow | 106/109 |
| 4,647,486 | 3/1987 | Ali | 428/70 |

FOREIGN PATENT DOCUMENTS

| | | |
|---|---|---|
| 51-137037 | 11/1976 | Japan . |
| 52-48667 | 4/1977 | Japan . |
| 53-07596 | 1/1978 | Japan . |
| 53-61474 | 5/1978 | Japan . |
| 53-147717 | 12/1978 | Japan . |
| 2053874 | 12/1978 | United Kingdom . |

*Primary Examiner*—Richard K. Seidel

*Attorney, Agent, or Firm*—Banner, Birch, McKie & Beckett

[57] ABSTRACT

An improved composition and process for preparing plaster molds used in casting nonferrous metals is provided wherein plaster molds are prepared from particulate calcium sulfate molding plaster admixed with insoluble calcium sulfate anhydrite whisker fibers.

15 Claims, 2 Drawing Sheets

FIBER REINFORCED PLASTER MOLDS FOR METAL CASTING

This application is a continuation Ser. No. 379,933, filed May 19, 1982, now abandoned.

TECHNICAL FIELD

This invention relates to processes for casting nonferrous metals using plaster molds. More particularly, this invention relates to improved compositions for producing plaster molds used in metal casting and to the resulting metal casting molds.

BACKGROUND OF THE INVENTION

The use of plaster molds in casting of nonferrous metals has long been well-known in the art. Plaster may easily be conformed to a desired pattern to be reproduced as a metal product, the plaster being hardened into a mold, usually in several sections. Molten metal is poured into the mold, allowed to cool and solidify, and the mold is removed from the casting.

The recognized advantages of plaster casting of metals include the low cost of both the plaster molding composition and the moldmaking process, and the ease with which high definition and accurate reproduction of pattern surfaces may be achieved using a plaster composition of suitable consistency. Despite reasons favoring plaster casting of metals, there are several recognized disadvantages to such processes as conventionally practiced. Plaster mold quality is dependent upon a number of variables which must be controlled, including consistency of the plaster molding composition, mold pouring procedures, and plaster curing techniques. Improper procedures may result in blow outs of molten metal from the casting mold, distorted cast metal product shapes due to shrinkage of the plaster mold during curing, rough surfaces of castings due to excessive plaster mold porosity, and complete failure of the metal casting process due to cracking of the plaster mold during the metal pouring step.

The need continues in the art for improvement in the quality of plaster compositions for producing metal casting molds, so that this convenient method of metal casting may be more easily employed. The plaster compositions of the present invention, which comprise insoluble calcium sulfate anhydrite whisker fibers resulting in metal casting molds of improved quality, are a significant contribution to this need.

SUMMARY OF THE INVENTION

It is an object of the present invention to provide improved plaster compositions for the production of molds for casting nonferrous metals.

It is another object of this invention to provide compositions for the production of molds for casting nonferrous metals having substantially increased strength and durability.

It is an additional object of this invention to provide improved methods of producing plaster molds for casting nonferrous metals, yielding plaster molds having sufficient durability and strength.

It is also an object of this invention to incorporate a reinforcing fiber which will not present any health hazard in the use of the metal casting.

It is yet another object of this invention to provide a metal casting plaster composition to reproduce original patterns with a high degree of accuracy and definition so as to reduce or eliminate subsequent clean-up of the casting.

It is yet a further object of the present invention to provide improved plaster mold members for casting nonferrous metals having a greatly increased capability for permitting accurate reproduction of desired patterns in cast metal form.

It is still another object of this invention to provide plaster molds for metal casting allowing for substantial elimination of casting blow outs, deformation of cast metal shapes due to plaster mold shrinkage, rough plaster mold surfaces resulting in rough surface metal products, and cracked molds resulting in partial or complete failure of the metal casting process.

In accordance with this invention, settable compositions for the production of molds for casting of nonferrous metals are provided, comprising particulate calcium sulfate molding plaster intimately admixed with an effective amount of insoluble calcium sulfate anhydrite whisker fibers.

The invention also provides a method for producing a mold member for casting nonferrous metals, comprising the steps of mixing water and a settable composition of the invention to form a slurry, applying the composition to a mold pattern in an amount sufficient to cover the desired portion of the surface of the pattern, and curing the composition with the pattern in place to produce a mold member.

The invention further contemplates mold members for casting nonferrous metals essentially consisting of a cured mixture of calcium sulfate molding plaster and insoluble calcium sulfate anhydrite whisker fibers.

Plaster molds used for metal casting are calcined (burned) to remove the chemically combined water so that there will be no water which could be released during the subsequent casting of the metal. A mineral fiber is commonly incorporated into the plaster so the mold will have sufficient strength to be handled after the calcination. Asbestos, fibrous talc, and Wollastonite have all been used as the mineral fiber reinforcing in conventional metal casting plasters. All of these have been associated with respiratory problems. Insoluble calcium sulfate anhydrite has no such limitation and, in addition, offers other improvements which will become apparent in the context of this application.

Additional embodiments of the invention will be made clear from the detailed discussion below.

DETAILED DESCRIPTION OF THE INVENTION

Figure 1:
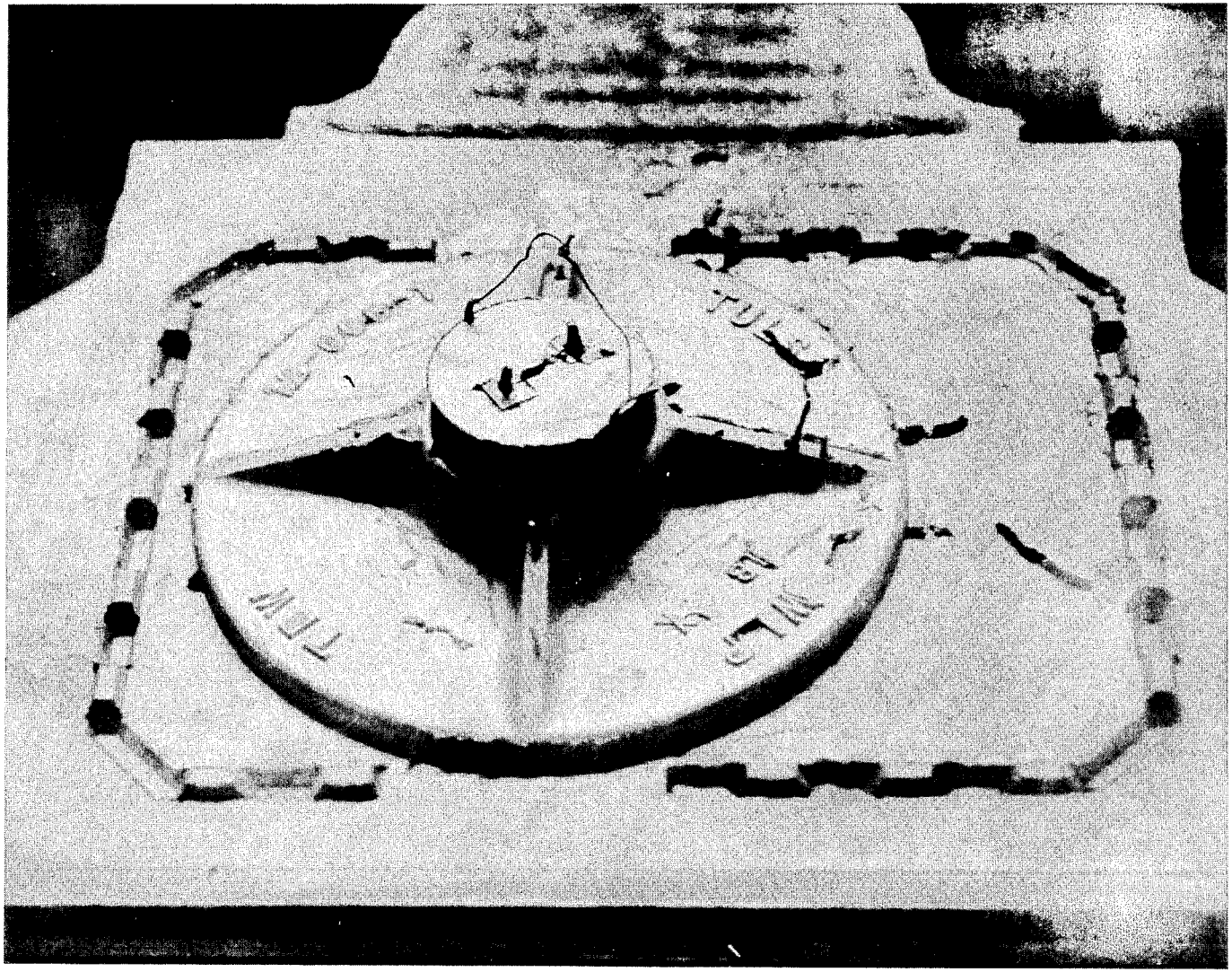
FIG. 1 is a photograph of the drag portion of a match plate mold made from standard metal casting plaster containing Wollastonite fibers, together with a metal casting produced using the drag and corresponding cope.

Broadly, this invention provides settable compositions for producing nonferrous metal casting molds, comprising particulate calcium sulfate molding plaster mixed with insoluble calcium sulfate anhydrite whisker fibers.

The primary ingredient in settable plaster molding compositions is calcium sulfate molding plaster. Normally, such plaster essentially consists of particulate calcium sulfate hemihydrate. Calcium sulfate hemihydrate molding plaster is commonly referred to as plaster of Paris, calcined gypsum, and stucco. Molding plaster is, of course, well known in the art.

The insoluble calcium sulfate anhydrite whisker fibers employed in the present invention have an average length-to-diameter aspect ratio of at least about 6:1, preferably about 10:1 to about 600:1. The length of whisker fibers generally ranges from about 5 to about 300 micrometers. Long fibers are preferred over short fibers. Diameters of whisker fibers generally range from about 0.2 to about 5 micrometers.

Suitable insoluble calcium sulfate anhydrite whisker fibers are known and may be prepared by methods known in the art (see, e.g., U.S. Pat. No. 3,822,340, U.S. Pat. No. 3,961,105, U.S. Pat. No. 4,029,512, and U.S. Pat. No. 4,152,408).

According to one embodiment, the insoluble calcium sulfate anhydrite whisker fibers comprise insoluble calcium sulfate anhydrite whisker fibers prepared according to the teachings of copending U.S. patent application Ser. No. 379,932, entitled "Insoluble Calcium Sulfate Anhydrite Whisker Fibers," filed on May 19, 1982. These whisker fibers have individual lenths of about 5 to about 300 micrometers, individual diameters of about 0.2 to about 5 micrometers, an average length-to-diameter aspect ratio of about 10:1 up to about 600:1, a surface area of at least about 15,000 $cm^2/g$ (preferably at lest about 18,000 to about 20,000 $cm^2/g$), a bulk density of about 7 pounds per cubic foot or less, and a normal consistency of about 500 to about 800 milliliters of water per 100 grams of fibers.

Since the particulate calcium sulfate molding plaster is the primary ingredient in the molding compositions, the insoluble calcium sulfate anhydrite whisker fibers normally constitute less than about 20% of the dry powder mixture. Higher proportions of whisker fibers may be used if desired, but considerations of economy dictate against such practice. Preferably, the whisker fibers constitute from about 3 to about 15% of the dry mixtures, and most preferably from about 5 to about 10%.

Optional materials known to those skilled in the art such as diatomacous earth, portland cement, lime, sand, accelerators and retarders may be added to the compositions as desired to serve their conventional purposes. All materials included in the molding compositions should be as devoid of soluble salts as is practicable. Soluble salts such as potassium salts are carried to the surface of the plaster mold during curing, potentially causing flaking and defacement of the mold surface. This phenomenon, known as efflorescence, should be controlled and preferably eliminated to facilitate production of acceptable cast metal products. Normally, any optional ingredients such as diatomaceous earth, portland cement, lime, sand, accelerators and retardants are present in minor amounts, if at all, according to conventional plaster formulation.

Once the desired proportions of particulate molding plaster, insoluble calcium sulfite anhydrite whisker fibers and optional ingredients have been determined for a particular metal castings plaster formulation, the ingredients are combined together and intimately admixed. Any dry mixing apparatus or techniques known to those skilled in the art may be employed. The plaster molding compositions may be employed as known in the art to produce plaster molds for casting any nonferrous metal such as aluminum, beryllium, copper, brass, bronze and their alloys.

The water which is combined with the plaster molding composition to initiate the setting process should be as pure as practical. Impurities in the water employed may hinder the hydration reaction in the plaster, resulting in inferior product molds. Salts present in the water may be carried to the surface of the mold during drying causing efflorescence and flaking of the mold surface. Impurities may also affect the rate of the setting reaction leading to undesired results.

Mixing of the plaster molding composition with water may generally be carried out using any apparatus or technique capable of uniformly mixing the entire batch, completing such mixing before setting of the plaster renders it unworkable, and preventing excessive aeration of the mixture. Suitable mixing apparatus and techniques are known in the art.

Sufficient water is added to the plaster to obtain the desired working consistency. Working consistency is defined as pounds of water per 100 pounds of plaster added together to produce a batch of plaster slurry. Generally, about 90 to about 150 pounds per 100 pounds of metal casting plaster is used. Preferably, about 100 to about 120 pounds water is employed. Excessively high consistency (i.e., too much water) may result in decreased green strength of plaster molds, decreased strength of molds subsequent to burn out, decreased mold density, increased permiability of molds, and increased time and energy requirements for removal of the water during oven curing. Benefits attending use of increased consistency, however, include reduction of setting expansion, reduction of burn out shrink, and ease of pattern removal from the cured mold. Generally, the consistency that will provide good workability, good flow and uniform pattern coverage, as well as adequate strength of the oven dried molds is employed. Working consistencies usually range from about 100 to about 130. Lower consistencies may be necessary for particular applications, e.g., where high density or green strength is a particularly important factor. The choice of an appropriate consistency is easily within the skill of this art.

In conventional practice, a pattern having the shape and surface characteristics of the desired product is prepared to shape the plaster mold. A parting compound is applied to the pattern surface so that the pattern may be removed from the cured plaster mold without damage to either. Pattern preparation techniques and suitable parting compounds include light oil cut with mica or stearic acid dissolved in kerosene. Other parting compounds are also known in the art.

The plaster mold is cured in an oven after it has set while still supported by the flask. The curing process involves burning out all chemically combined and physically bound water from the hydrated set plaster mold.

Complete dryness of the oven cured plaster molds may be determined by known measurement methods of the internal temperature of the molds and by drying the molds until a constant weight is obtained. Measurement of internal mold temperatures may be carried out by embedding a thermocouple in the center of the thickest portion of the mold, and recording the internal temperature. Once the internal temperature has exceeded the boiling point of water, 212° F., drying hs been completed. These test methods and others like them are well known to those skilled in the art.

Figure 2:
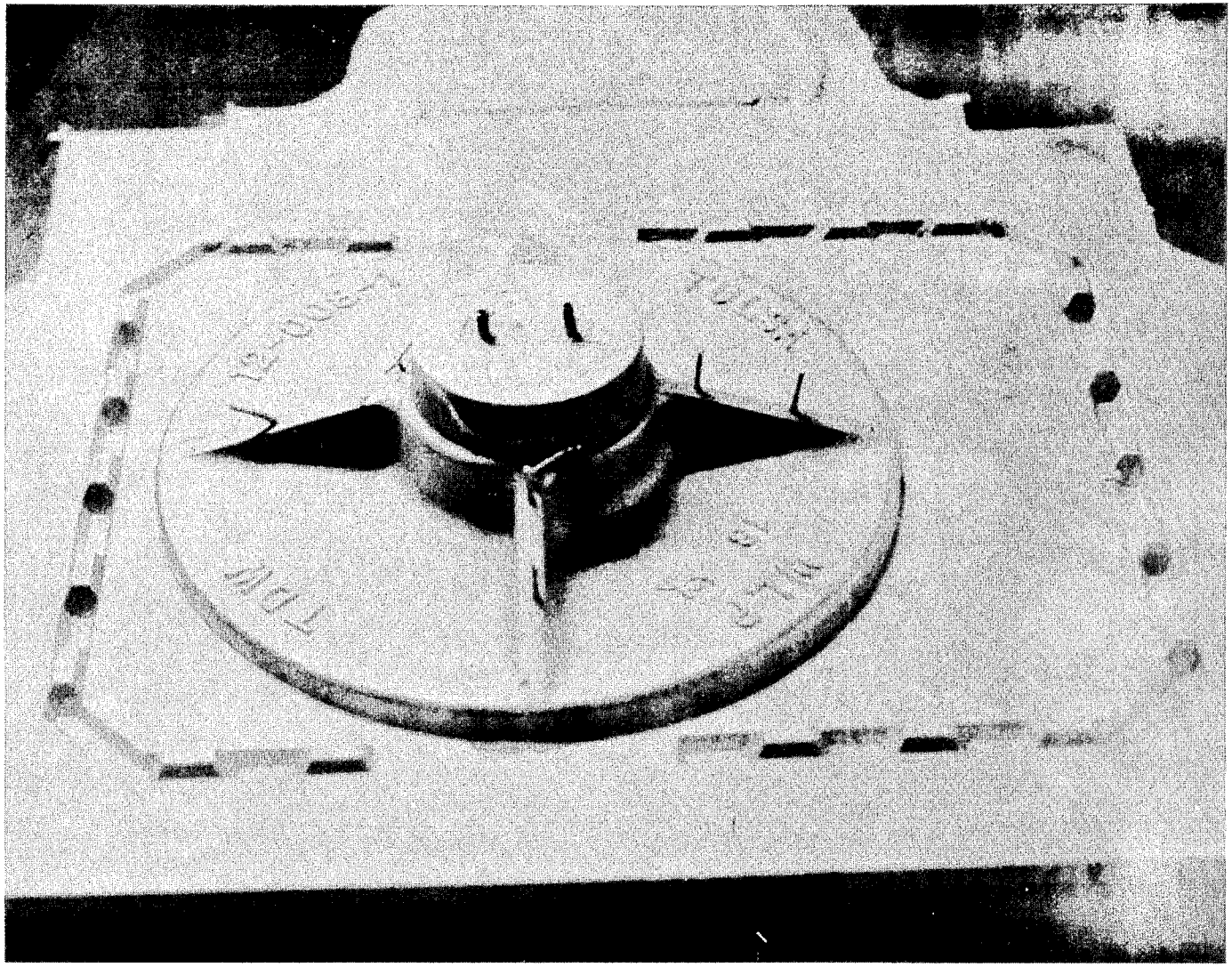
FIG. 2 is a photograph of the drag portion of a match plate mold produced using a metal casting plaster formulation comprising insoluble calcium sulfate anhydrite whisker fibers, together with a metal casting produced using the drag and corresponding cope.

One particular known method for metal casting involves the use of match plate plaster molds. Match plate molds comprise two plaster mold halves which fit together forming a mold cavity, the mold halves being separated readily for preparation for the casting of the metal. FIGS. 1 and 2 illustrate match plate molds. The complimentary match plates for each of these molds have been removed to show the finished metal castings. The raised cleats in a rectangular pattern on the flat surface of the match plate interlocks with a corresponding pattern on the match plate not shown for proper alignment between the two match plates.

After the plaster has set, the bottom of the surface facing the pattern is removed and the flask is turned upside down. The flask is extended upward by adding another flask section to hold additional plaster, the pattern is retained in the first portion of the mold, and additional plaster is poured on top of the exposed side of the pattern and allowed to set. The resulting assembly is then cured in an oven, and the two plaster sections, termed the drag and the cope in order of pouring, are separated from each other to constitute a two-piece plaster mold.

The metal casting molds produced using the plaster compositions containing whisker fibers have increased strength as compared with metal casting molds produced from conventional plaster formulations. The whisker fibers themselves possess high tensile strength which results in increased dimensional stability and shock resistance. The plaster molds produced in accordance with the present invention exhibit greatly reduced incidence of thermal shock cracking which results in a significant improvement in the quality and clean-up of the cast metal products. In addition, the molds for metal casting produced according to this invention are permeable to permit the exit of gases emitted during the casting of the metal.

The metal casting process itself is well-known to those skilled in the art and need not be discussed in detail here. The metal casting mold is usually heated immediately before undertaking the metal casting in order to minimize thermal shock caused by the difference in temperature between the molten metal and the plaster and also to remove residual water.

The invention is further illustrated by the following Examples. These Examples are merely illustrative and are not intended to limit the scope of the invention, which is defined in and limited only by the appended claims.

EXAMPLE 1

A typical formula for a prior art metal casting plaster is as follows:

| Ingredient | Pounds | Percent |
|---|---|---|
| Molding Plaster | 1650 | 81.95 |
| Wollastonite F-1 | 100 | 4.97 |
| Celite FC | 250 | 12.42 |
| Type I Portland Cement | 12 | .60 |
| High Calcium Lime | 1.1 | .05 |
| Gypsum Accelerator | .5 | .03 |

FIG. 1 shows a metal casting produced from a match plate mold made from the above formulation.

EXAMPLE 2

A formula of the present invention including gypsum fibers is as follows:

| Ingredient | Pounds | Percent |
|---|---|---|
| Molding Plaster | 1758 | 87.3 |
| Insoluble Calcium Anhydrite Fibers | 242 | 12 |
| Type I Porland Cement | 12 | .60 |
| High Calcium Lime | 1.0 | .05 |
| Gypsum Accelerator | .5 | .03 |

The insoluble calcium anhydrite whisker fibers employed above had a normal consistancy of about 220 milliliters water per 100 grams of fibers. They were prepared by dehydration of dihydrate gypsum (Terra Alba) to hemihydrate fibers which were then heated to provide insoluble fibers. Such fibers were produced according to the general procedure of Example 1 of copending Gettel U.S. application Ser. No. 379,932, entitled "Insoluble Calcium Sulfate Anhydrite Whisker Fibers" filed concurrently herewith. FIG. 2 shows a metal casting produced from a match plate mold made from the above formulation.

Comparing the casting of FIG. 1 with the casting of FIG. 2, it can be readily seen that the gypsum fiber formulations of the present invention produced a superior metal casting.

EXAMPLE 3

A formula of the present invention employing the novel gypsum fibers produced according to the teachings of the above Gettel copending U.S. patent application is as follows:

| Ingredient | Pounds | Percent |
|---|---|---|
| Molding Plaster | 1875 | 93.1 |
| Insoluble Calcium Anhydrite Fibers | 125 | 6.2 |
| Type I Portland Cement | 12 | .60 |
| High Calcium Lime | 1.0 | .05 |
| Gypsum Accelerator | .5 | .03 |

The whisker fibers employed above had a normal consistancy of about 700 milliliters water per 100 grams of fibers.

While preferred embodiments of this invention have been discussed above and illustrated by the Examples, it is to be understood that modifications in the invention may be made as known to those skilled in the art.

We claim:

1. A mold member useful for the casting of nonferrous metals comprising a cured mixture of calcium sulfate molding plaster and at least about 3% by weight insoluble calcium sulfate anhydrite whisker fibers based on the dry weight of the mixture.

2. The mold member of claim 1 in which the insoluble calcium sulfate anhydrite whisker fibers have an average length-to-diameter aspect ratio of at least about 6:1.

3. The mold member of claim 1 in which the insoluble calcium sulfate anhydrite whisker fibers have an average length-to-diameter aspect ratio of at least about 10:1.

4. The mold member of claim 1 in which the insoluble calcium sulfate anhydrite whisker fibers have a surface area of at least about 15,000 $cm^2/g$.

5. The mold member of claim 1 in which the insoluble calcium sulfate anhydrite whisker fibers have a surface area of at least about 18,000 $cm^2/g$.

6. The mold member of claim 1 additionally comprising at least one ingredient selected from the group consisting of diatomaceous earth, portland cement, lime, sand, accelerators and retarders.

7. A method of producing a mold member for casting nonferrous metals, comprising the steps of:

(a) mixing water and a composition comprising water-settable calcium sulfate molding plaster intimately admixed with an effective amount of insoluble calcium sulfate anhydrite whisker fibers to form a slurry, (b) introducing the composition into a molding flask containing a mold pattern in an amount sufficient to partially cover the surface of the pattern in the flask, and (c) curing the composition with the pattern in place in the flask to produce a mold member.

8. The method of claim 7 in which the insoluble calcium sulfate anhydrite whisker fibers comprise at least about 3% by weight of the dry weight of the composition.

9. A method of producing a mold member for casting nonferrous metals, comprising the steps of:

(a) mixing water and a composition comprising particulate calcium sulfate molding plaster intimately admixed with insoluble calcium sulfate whisker fibers in an amount of from about 3 to about 20%, based on the dry weight of the mixture, to form a slurry having a consistency of from about 90 to about 150 pounds of water per 100 pounds of the composition, (b) introducing the composition into a molding flask containing a mold pattern in an amount sufficient to partially cover the surface of the pattern in the flask, and (c) curing the composition with the pattern in place in the flask to produce a mold member.

10. The method of claim 7 or 9 in which the insoluble calcium sulfate anhydrite whisker fibers have a surface area of at least about 18,000 $cm^2/g$.

11. The method of claim 7 or 9 in which the pattern is removed from the mold member.

12. A mold member for casting nonferrous metals produced according to the method of claim 7 or 9.

13. The method of claim 7 or 9 in which the insoluble calcium sulfate anhydrite whisker fibers have an average length-to-diameter aspect ratio of at least about 6:1.

14. The method of claim 7 or 9 in which the insoluble calcium sulfate anhydrite whisker fibers have an average length-to-diameter aspect ratio of at least about 10:1.

15. The method of claim 7 or 9 in which the insoluble calcium sulfate anhydrite whisker fibers have a surface area of at least about 15,000 $cm^2/g$.

* * * * *